US005608995A

United States Patent [19]

Borden

[11] Patent Number: 5,608,995

[45] Date of Patent: Mar. 11, 1997

[54] SOLAR-ACTUATED FLUID WINDOW SHUTTER

[76] Inventor: Rex M. Borden, 8158 Kenova St., San Diego, Calif. 92126

[21] Appl. No.: 518,556

[22] Filed: Aug. 15, 1995

[51] Int. Cl.[6] ..... E06B 7/00

[52] U.S. Cl. ..... 52/171.3; 359/886; 428/34

[58] Field of Search ..... 52/171.3, 172, 52/786.1, 786.11, 786.13, 788.1, 204.51, 209, 204.52, 204.593, 204.599, 204.6, 2.13, 2.14, 2.17, 2.22, 656.5, 656.6; 428/34; 359/886, 889, 892

[56] References Cited

U.S. PATENT DOCUMENTS

| | | | |
|---|---|---|---|
| 2,288,465 | 6/1942 | Knudsen | 52/786.1 |
| 2,332,060 | 10/1943 | Colleran | 189/64 |
| 2,464,954 | 3/1949 | Werth | 52/786.1 X |
| 3,695,681 | 10/1972 | Dockery | 52/171 X |
| 3,723,349 | 3/1973 | Heseltine et al. . | |
| 3,724,929 | 4/1973 | Lacy | 350/312 |
| 3,761,165 | 9/1973 | Besnard | 350/312 |
| 4,044,519 | 8/1977 | Morin et al. | 52/171 X |
| 4,166,345 | 9/1979 | Becker | 52/172 |
| 4,236,360 | 12/1980 | Parrier et al. | 52/171.3 |
| 4,261,331 | 4/1981 | Stephans . | |
| 4,288,953 | 9/1981 | Whiteford | 52/171 |
| 4,459,789 | 7/1984 | Ford | 52/656 |
| 4,556,446 | 12/1985 | Yudenfriend | 156/551 |
| 4,819,405 | 4/1989 | Jackson | 52/209 X |
| 5,079,886 | 1/1992 | Downs | 52/314 |
| 5,152,111 | 10/1992 | Baughman et al. | 428/34 X |
| 5,167,993 | 12/1992 | Aoyagi | 428/34 |

FOREIGN PATENT DOCUMENTS

| | | | |
|---|---|---|---|
| 2555648 | 5/1985 | France | 52/171.3 |
| 3401226 | 10/1984 | Germany | 52/171.3 |
| 2161853 | 1/1986 | United Kingdom | 428/34 |

OTHER PUBLICATIONS

Wilson, Alex, Jun. 1993. No Pane No Gain: Window Technology Part 1. Popular Science pp. 92–98.

Wilson, Alex, Jul. 1993. Through a Glass Darkly: Window Technology Part 2. Popular Science pp. 81–87.

*Primary Examiner*—Carl D. Friedman

*Assistant Examiner*—Aimee E. McTigue

[57] ABSTRACT

A window shutter device for automatic regulation of solar illumination in response to variations in external sunlight. Gas pressure change in a sunlit cavity causes fluid displacement between two transparent window panes. A transparent fluid is displaced by another fluid which blocks part of the sunlight falling on the panes. Glare is prevented while preserving adequate interior illumination and a clear view outside the window.

6 Claims, 2 Drawing Sheets

SOLAR-ACTUATED FLUID WINDOW SHUTTER

BACKGROUND OF THE INVENTION

1. Field of the Invention

This invention relates to windows in buildings. Intensity of sunlight passing through the window is automatically controlled and regulated at comfortable intensity in response to natural variations in sunlight, and is insensitive to ambient temperature. A clear undistorted view is maintained while eliminating glare.

2. Description of the Related Art

Prior art for automated window shutters may be classified by control inputs as either thermal or solar-sensitive. Temperature-sensitive thermal shutters are suitable to reduce energy costs of space heating and/or cooling. They operate without regard to interior illumination, and often distort or interfere with vision.

U.S. Pat. No. 4,261,331 for example describes a thermal shutter where a crystalline solute is precipitated from solution above a threshold temperature. Crystals suspended in the solution scatter light back out of the window and thereby regulate interior temperature. U.S. Pat No. 3,723,349 discloses a thermochromic material which also changes its color in response to temperature. Popular Science July 1993 page 83 describes "Cloud Gel" as a thermal-sensitive polymer suspension. Submicron size polymer strands aggregate when hot to scatter and reflect sunlight. The solution color appears to change from clear to white. Each of these automatic shutters reduces light penetration when the window surface becomes hot.

Solar-sensitive shutters, unlike thermal shutters, serve to regulate and control illumination at a level which is useful and comfortable, regardless of window surface or building interior temperature. This invention belongs to the latter category.

Prior art may be further classified according to control response as mechanical, electrochromic, or fluidic. The mechanical category includes powered operation of familiar window coverings which are conventionally operated by hand.

Several examples of the mechanical type are known wherein a switch actuates a motor-controlled mechanism to draw or lower a shade or shutter, actuate a blind, or by the use of cables, pulleys or gears move a curtain, shade or shutter located at the inner surface of a window. Such mechanical devices are costly, complex and trouble-prone. In addition, they may be considered unaesthetic by standards of the 1990's.

Examples of electrochromic window shutters are described for example in Popular Science of July 1993. Electro-optical materials sandwiched between transparent window panes vary their light transmission in response to a voltage imposed between the two panes. A continuous voltage supply is required to hold the shutter either open (transparent) or closed, depending on the type of technology employed. Most of these shutters interfere with the visual image through the window. All of them are too expensive for practical or widespread use. Further, their lives are limited by unwanted photochemical or electrochemical side reactions.

This invention is the only known example of an automatic fluidic window shutter.

SUMMARY OF THE INVENTION

The principal object of this invention is to regulate interior illumination at a level which is adequate, comfortable and free of glare in spite of natural variations in sunlight falling on the window. Further objects are to overcome deficiencies in prior art with a device that is inexpensive, durable, trouble-free, aesthetic and insensitive to variation in ambient temperature. A further objective is to operate without need for electric or other power source.

An alternate objective is to enhance privacy with a shutter that is open during sunlit conditions and automatically closes during darkness or overcast conditions.

The present invention is classified as solar-sensitive with regard to input and fluidic with regard to control response. It satisfies all the stated objectives with a low-cost device having no moving parts, no need for power and nothing to degrade or wear out.

Paired transparent vertical window panes are separated by a distance which is generally less than their thickness. The panes may be of glass or any other rigid transparent sheet material such as acrylic, polycarbonate, polyester etc. Pressure between these panes is near or below atmospheric at the bottom. Pressure at the top of the panes is less than that at bottom by an amount equal to the hydrostatic pressure of fluids confined between them.

A constant spacing is maintained in spite of partial vacuum by shims or spacers between the panes. The spacers may be made of monodisperse glass beads, chopped monofilament line, or coarsely crushed microscope slide covers for example. Spacers may be distributed uniformly or randomly. They occupy a small fraction of the window's area.

Fluids are confined between the panes by sealing them at both vertical edges. Bottom and top edges are sealed as well except as required for flow to top and bottom fluid reservoirs. The fluid reservoirs are partially filled with a gas such as air, nitrogen or argon. The reservoirs may be physically contiguous with upper and lower edges of the panes, in which case the space between panes may be open to the reservoirs across the entire length of their horizontal edges. Alternatively, fluids may flow to the reservoirs through narrow tubes or channels. In the latter case, horizontal edges of the panes must be otherwise sealed and the reservoirs need not be contiguous with or even near edges of the corresponding panes.

Both reservoirs are connected at their bottoms to the cavity between panes. Thus, it is fluid rather than gas which flows between reservoirs. Gas is confined above fluid in each reservoir. Volumes are proportioned so that gas never enters the cavity between panes in normal conditions, unless desired.

Two immiscible fluids of different density are confined between the panes. The more dense fluid is relatively transparent and colorless, and therefore is optically transmissive. The less dense fluid which floats on top of the transmissive fluid contains dissolved dye or suspended fine particles or colloids. This lighter fluid is less transmissive and attenuates sunlight passing through it. It is referred to herein as the attenuation fluid. Suitable dye solutions, colloids or suspensions may be prepared by conventional means in any desired color, or may be colorless and milky white or gray. Attenuation fluid reduces passage of sunlight due to light scattering or absorption.

There is a difference in gas pressure between top and bottom reservoirs due to hydrostatic pressure from windowfilling fluids and due to the difference in their heights. A change in the gas pressure difference between reservoirs results in a displacement of fluids. A change in ambient temperature affects pressure in both reservoirs proportionately, other things being constant. Thus displacement of fluids is insensitive to variation in ambient temperature.

If the reservoirs are located at nearly the same height, their gas pressures can be equal when their temperatures are the same. This is the case when the hydrostatic pressure of transmissive fluid below its surface in the lower reservoir equals the hydrostatic pressure of attenuation fluid below its surface in the upper reservoir. The attenuation fluid surface is then slightly higher than the transmissive fluid surface due to the difference in density of the two fluids. With this embodiment of the current invention, an equal change in gas temperature in both reservoirs does not produce any fluid displacement at all. In addition, the system can be manually or automatically balanced at night or during non-sunlit conditions by momentarily allowing gas to flow between the two reservoirs.

The lower reservoir is shielded from sunlight. The upper reservoir is exposed to sunlight for automatic operation of the shutter. Solar illumination heats the upper gas and produces a displacement of fluid from upper to lower reservoir. The dense transmissive fluid is displaced from the cavity between panes and is replaced by the lighter attenuation fluid, diminishing solar illumination entering the building through the automatic shutter. The upper reservoir may be transparent on the sunlit side and darkly colored at the opposite interior surface to intensify the solar-induced pressure change.

Alternatively, the shutter may be operated manually by altering pressure in either reservoir using a pump or other means. By this means automatic solar operation may be overridden manually to open or close the shutter at will. Pumping may be arranged to reversibly transfer gas between upper and lower reservoirs for manual operation.

Many organic fluids are immiscible in water and are suitable for this invention. Fluids lighter than water include hydrocarbons such as heptane, petroleum naphtha, toluene etc. Also lighter than water are ethers such as tetrahydrofuran, dioxane, diisopropyl ether etc. Organic fluids heavier than water include halocarbons such as carbon tetrachloride, trichloroethane, chloroform and their fluoro- or bromo-counterparts. The halocarbons are immiscible with hydrocarbons, so that water-free fluid systems are possible. In this case the attenuation fluid would be a hydrocarbon and the transmissive fluid would be a fluorocarbon.

An alternative variation of this invention is to reverse the relative positions of the light attenuation fluid and light transmissive fluid so the light transmissive hydrocarbon or ether rests above a light attenuation fluid such as water containing India ink. With the transmissive and attenuation fluids reversed or inverted, the shutter opens to sunlight and closes to darkness. This configuration is useful to protect privacy of building occupants.

The shutter may be protected from hydrostatic pressure by installing a check valve at the lower reservoir permitting outward flow only.

The present invention is in no way limited to the aforementioned light attenuation fluids and light transmissive fluids, as variations of natural or synthetic oils, and silicone based fluids may be used in the present invention. Nor is the present invention limited to two and only two immiscible fluids as similar light attenuation or illumination control can be effected with one fluid or three or more fluids.

A surfactant may be added to a given fluid to reduce surface tension within the cavity or the surfaces of the cavity may be coated with fluorocarbon polymer.

Figure 1:
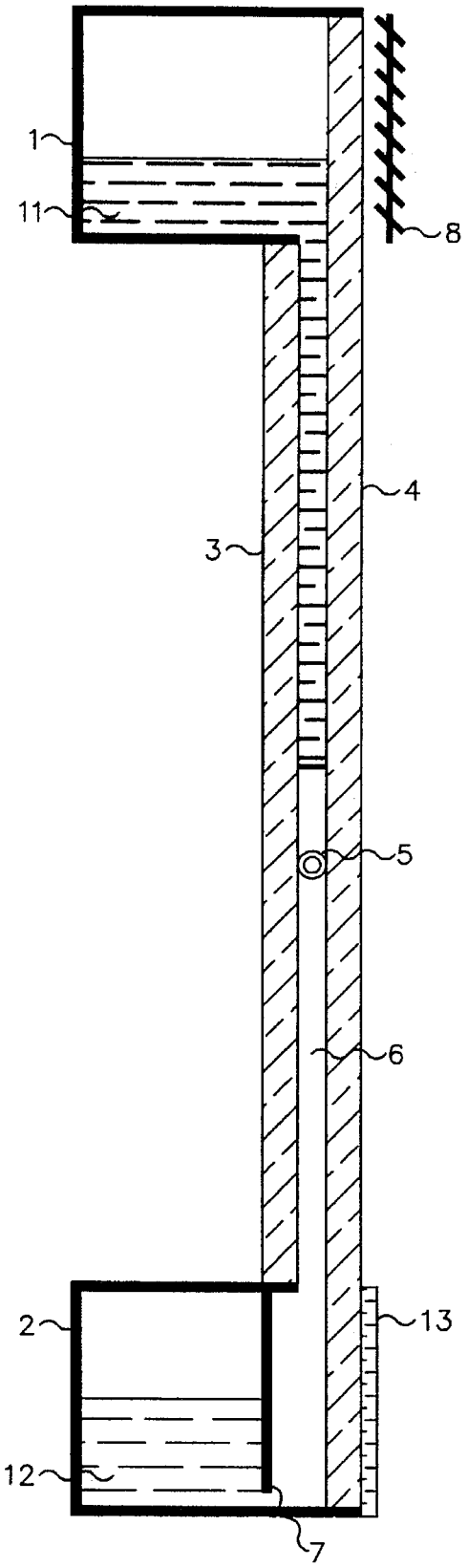
FIG. 1 shows a cross-section of one possible embodiment of this invention.
Figure 2:
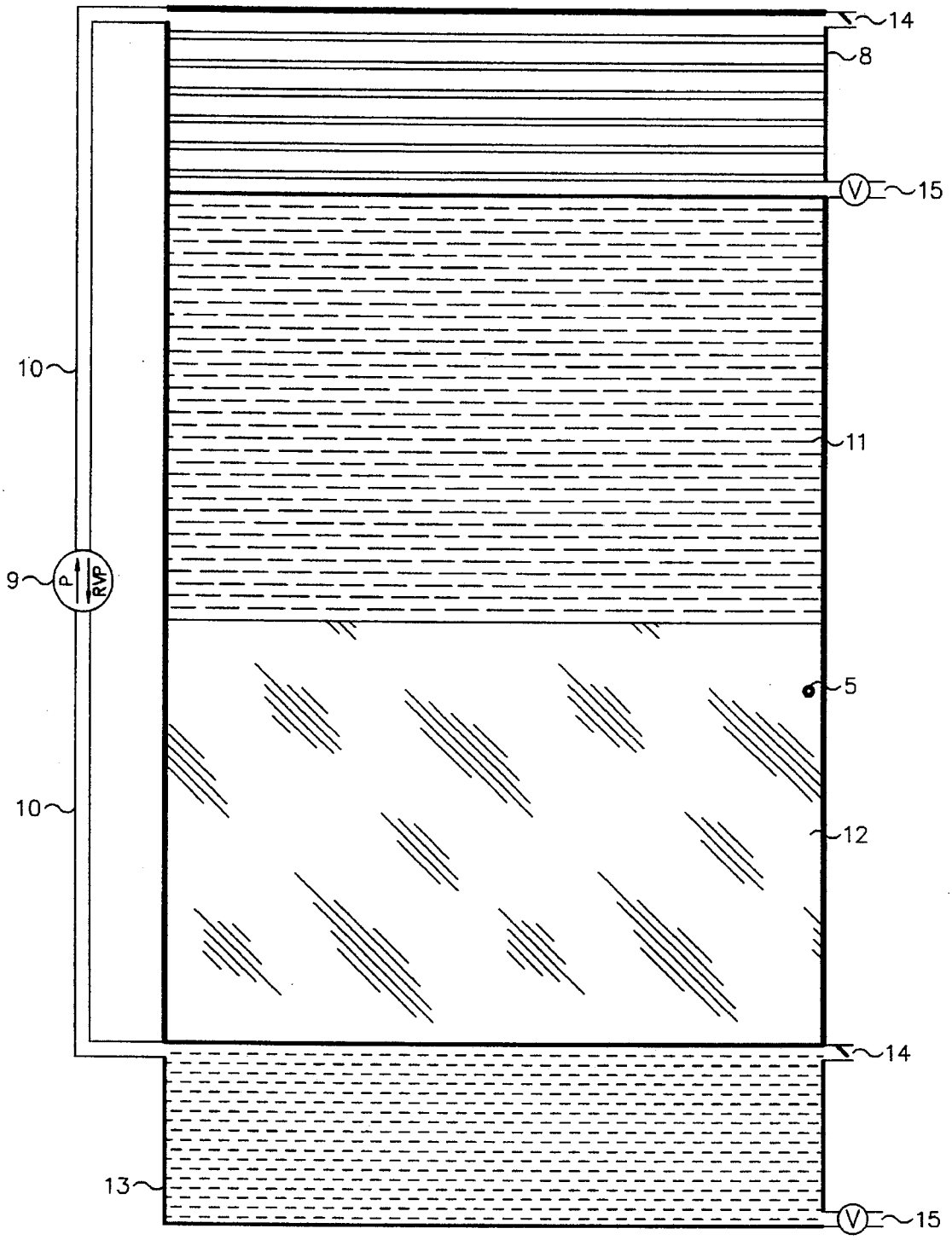
FIG. 2 shows the corresponding front view. Two vertical panes of glass (3) and (4) are sealed at their vertical edges by silicone caulk or other means (not shown). Many small transparent spacers (5) are distributed in the cavity (6) between panes to control their separation. The spacers are selected for uniform thickness. They may be adhesively bonded to one of the panes prior to assembly of the shutter.

Glass bead spacers are exaggerated in size in FIGS. 1 and 2 for clarity. Interpane spacing and glass thickness are exaggerated in FIG. 1 for purposes of exposition as well.

A gas tight upper reservoir (1) is contiguous with the shutter cavity (6) and open to it along the entire upper edge of the panes. A gas tight lower reservoir (2) is contiguous with the shutter cavity and open to it along the entire lower edge of the panes. The opening to the shutter cavity is located near the bottom of the lower reservoir.

Some fluid storage capacity is provided at the lower edge of the shutter cavity by a baffle (7) inside the lower reservoir. During periods of particularly intense sunlight, this prevents attenuation fluid from being driven irreversibly into the lower reservoir where it would float on top of the transmissive fluid.

The upper reservoir (1) is bounded on the sunlit side by the outer window pane (4) to admit light. The inner surface of the upper reservoir is darkly colored to absorb sunlight.

The sunlit side of the lower reservoir is shielded from light by a reflective surface (13) which may be white paint or a glass mirror for example.

A reversible air pump (9) is connected by tube (10) between the upper reservoir (1) and the lower reservoir (2) to manually open or close the shutter.

This arrangement allows for zero sum pneumatic operation or calibration of the present invention as the relationship of internal pressure and external pressure of the closed system remains undisturbed by the aforementioned actuation of the pump (9). The pump (9) and the tubing (10) need not be permanently attached, but may be temporarily attached to the pneumatic evacuation and calibration ports (14) which are located at the upper most parts of the reservoirs (1) and (2). The pump (9) may be attached to the upper port (14) in the upper reservoir (1) alone to permit evacuation of air or gases from the upper reservoir (1) so as to vary the gas pressure in the upper reservoir (1) to effect the vertical transfer of fluid through the cavity (6). Two way fluid ports (15) are placed at the bottom most parts of the reservoirs (1) and (2). The fluid ports (15) are for the charging and evacuation of fluids into and out of the cavity (6) and reservoirs (1) and (2). Said fluid ports (15) may be used for operation and calibration in conjunction with the pneumatic ports (14). The fluid ports (15) may be used without altering the relative gas pressures in the reservoirs (1) and (2) to fully operate the device. An example of fluid only operation is to simply add the same amount of fluid through the upper port (15) as being evacuated through the lower port (15). This is zero sum hydraulic operation or calibration.

The optically transmissive fluid (12) may be water for example. Attenuation fluid (11) can be a water-immiscible organic solvent such as tetrahydrofuran or heptane containing suspended colloidal carbon or a hydrophobic organic dye for example.

A movable louver (8) is made of thin opaque slats hinged on horizontal axes so that the multiple slats remain parallel regardless of rotational position. Adjustment of louver (8) moderates intensity of sunlight falling on upper reservoir (1) to reduce sensitivity of its control response. An equivalent reduction in sensitivity can be provided without louver (8) by evacuating lower reservoir (2) to less than atmospheric pressure while reducing pressure in upper reservoir (1) by the same amount.

Upper valve (15) may be used to admit attenuation fluid. Lower valve (15) may be used to admit and evacuate transmissive fluid. Upper and lower valves (14) may be used to admit air. All valves (14) and (15) provide additional flexibility for adjustment of reservoir gas pressures and fluid interface level.

A method of initial calibration is described as follows. The louver (8) is assumed to be closed therefore neither the upper reservoir (1) or lower reservoir (2) is exposed to direct sunlight. The fluids have been carried or confined in the cavity (6) and reservoirs (1) and (2) as depicted in FIG. 2 with some of the light attenuation fluid (11) and light transmissive fluid (12) in the cavity (6). The proper method of confining said fluid in the device so as to avoid possible bursting of the cavity due to hydrostatic pressure is to draw the fluids into the device through the bottom fluid port (15) by evacuating gas through the upper pneumatic port (14). Air or gas is then further evacuated forming a partial vacuum in the upper reservoir (1) resulting in less gas pressure therein and displacement of fluid upward through the cavity (6). When the horizontal interface of the fluids (11) and (12) reaches the uppermost portion of the cavity (6) evacuation is ceased. The lower reservoir (2) can be likewise evacuated to bring the interface of said fluids (11) and (12) towards its original position. The evacuation process is repeated until the upper reservoir (1) has a partial vacuum and a gas pressure less than atmospheric, when the interface of the fluids is located at the uppermost edge of the cavity (6). The window or device is now transmissive of light because the cavity (6) contains only transmissive fluid (12). The device is also in a dark or quiescent state as the internal temperatures in both reservoirs (1) and (2) are equal. A change in ambient temperature has little effect on the movement of the fluids (11) and (12) through the cavity (6) as the temperature change is felt equally in both reservoirs (1) and (2).

Once the aforementioned calibrated initial state is achieved the louver (8) is partially or completely opened to expose the upper reservoir (1) to the same illumination or direct sunlight that is presently being transmitted through the cavity (6) now filled with the light transmissive fluid (12). The louver (8) is used to vary the intensity of illumination which passes through the outside pane (4) into the upper reservoir (1). The illumination strikes the darkly colored surface inside the upper reservoir (1) and is converted into heat. The heat gain results in an increase of gas pressure in the upper reservoir (1). Thus the intensity of illumination the upper reservoir (1) is exposed to, is varied to change the internal gas pressure of said upper reservoir (1) and cause the fluids (11) and (12) to be displaced.

It is seen at this point that the differential heat gain or accumulated heat in the upper reservoir (1) relative to the lower reservoir (2) alters the relative gas pressures between the reservoirs (1) and (2) to cause displacement of light attenuation fluid (11) down through the cavity (6). The controlled heat gain in the upper reservoir (1) prevents unwanted heat gain to the area shaded by the light attenuation fluid (11). Because of the relative different volumes between the reservoirs (1) and (2) and cavity (6), a very small vertical displacement of fluids in the reservoirs (1) and (2) results in a much larger vertical displacement of fluid in the cavity (6). Pneumatically actuated hydraulic amplification has been achieved where said pneumatic actuation is the result of controlled heat gain in the upper reservoir (1) as the intensity of illumination permitted to enter the upper reservoir (1) is varied. It is apparent at this juncture that the intensity of illumination or direct sunlight permitted to enter the upper reservoir (1), and not a change in ambient temperature, is the principal agent of automatic actuation of the present invention. The device is, therefore, solar sensitive and solar actuated requiring no external power source.

When the illumination is removed from the upper reservoir (1) by the louver (8), nightfall or cloudy weather the accumulated heat or heat gain in the upper reservoir (1) is dissipated and the temperatures equalize between the reservoirs (1) and (2). This allows the fluid interface to be displaced upward through the cavity (6) to its original calibrated location.

The maximum solar energy flux is a constant equal to approximately 900 watts/square meter, depending on altitude and latitude. Maximum noontime solar flux in clear weather varies less than 5% for any particular location. Gas and liquid reservoir volumes are computed as appropriate for each geographical location. However, should the intensity of illumination provided to the upper reservoir (1) exceed expectation or design parameters on some occasions, a widening of the cavity (6) at its lower most edge is provided for. A baffle (7) is shown as a widened portion of the cavity (6) where the upper immiscible fluid (11) is allowed to accumulate. This prevents the upper immiscible fluid (11) from rounding the end of the inside pane (3) and bubbling up through the lower immiscible fluid (12).

DESCRIPTION OF THE PREFERRED EMBODIMENTS

Based on the ideal gas law computer modeling for the preferred embodiment is as follows,

Models

All units are CGS absolute (cm, Kelvins, atm). The working fluids are assumed to be nonvolatile and immiscible. Subscript c refers to the cold dark condition where both reservoirs are at the same temperature. Subscript h refers to the sunlit condition where the upper reservoir is exposed to sunlight. Lower case t, p and v refer to temperature, pressure and volume in lower reservoir. Upper case T, P, and V refer to temperature, pressure and volume in upper reservoir.

| MODEL 1 | |
|---|---|
| Window height = 6 ft | 180 |
| Air reservoir thickness | 8.89 |
| Air reservoir height | 20.32 |
| Initial temperature, tc=Tc=th | 288 |
| Final upper temperature Th | 299.9 |
| Lower reservoir cold gas volume, vc | 180.645 |
| Upper reservoir hot gas volume, Vh | 180.645 |
| Lower reservoir hot gas volume, vh | 178.845 |
| Upper reservoir cold gas volume, Vc | 178.845 |
| Window fluid thickness, cm | 0.010 |

-continued

| MODEL 1 | | |
|---|---|---|
| Hydrostatic pressure diff water | | 0.179 |
| Hydrostatic pressure diff oil | | 0.170 |
| Upper reservoir initial pressure, Pc | | 0.514 atm |
| Lower reservoir initial pressure, pc | | 0.693 atm |
| Upper reservoir hot pressure, Ph | | 0.530 atm |
| Lower reservoir hot pressure, ph | | 0.700 atm |
| s.g. of upper oil fluid, g/cm3 | | 0.950 |
| Required delta T | 11.899° C. | 21.4° F. |

| MODEL 2 | | |
|---|---|---|
| Window height = 6 ft | | 180 |
| Air reservoir thickness | | 8.89 |
| Air reservoir height | | 10.16 |
| Initial temperature, tc=Tc=th | | 288 |
| Final upper temperature Th | | 308.8 |
| Lower reservoir cold gas volume, vc | | 90.322 |
| Upper reservoir hot gas volume, Vh | | 90.322 |
| Lower reservoir hot gas volume, vh | | 88.522 |
| Upper reservoir cold gas volume, Vc | | 88.522 |
| Window fluid thickness, cm | | 0.010 |
| Hydrostatic pressure diff water | | 0.179 |
| Hydrostatic pressure diff oil | | 0.161 |
| Upper reservoir initial pressure, Pc | | 0.703 atm |
| Lower reservoir initial pressure, pc | | 0.882 atm |
| Upper reservoir hot pressure, Ph | | 0.739 atm |
| Lower reservoir hot pressure, ph | | 0.900 atm |
| s.g. of upper oil fluid, g/cm3 | | 0.900 |
| Required delta T | 20.818° C. | 37.5° F. |

| MODEL 3 | | |
|---|---|---|
| Window height = 6 ft | | 180 |
| Air reservoir thickness | | 8.89 |
| Air reservoir height | | 10.16 |
| Initial temperature, tc=Tc=th | | 311 |
| Final upper temperature Th | | 333.5 |
| Lower reservoir cold gas volume, vc | | 90.322 |
| Upper reservoir hot gas volume, Vh | | 90.322 |
| Lower reservoir hot gas volume, vh | | 88.522 |
| Upper reservoir cold gas volume, Vc | | 88.522 |
| Window fluid thickness, cm | | 0.010 |
| Hydrostatic pressure diff water | | 0.179 |
| Hydrostatic pressure diff oil | | 0.161 |
| Upper reservoir initial pressure, Pc | | 0.703 atm |
| Lower reservoir initial pressure, pc | | 0.882 atm |
| Upper reservoir hot pressure, Ph | | 0.739 atm |
| Lower reservoir hot pressure, ph | | 0.900 atm |
| s.g. of upper oil fluid, g/cm3 | | 0.900 |
| Required delta T | 22.480° C. | 40.5° F. |

Study of the first two models reveals that as reservoir volume decreases relative to cavity volume, greater differential heat gain or delta T is required to displace the light attenuation fluid (11) completely through the cavity (6). MODEL 1 and MODEL 2 have the initial temperature of 288° Kelvin or 59° Fahrenheit. In MODEL 1 with a reservoir volume of approximately 180cc, approximately 12° centigrade delta T is necessary to completely displace the light attenuation fluid (11) through the cavity (6). In MODEL 2 with a reservoir volume of approximately 90cc it is seen that now approximately 21° centigrade delta T is required to displace the light attenuation fluid (11) through the cavity (6).

In MODEL 3 all physical dimensions are the same as in MODEL 2. The device in MODEL 3 has been calibrated to have the same initial pressures as shown in MODEL 2 at the initial temperature of 311° Kelvin or 100.4° Fahrenheit. It is seen that as ambient temperature increases, greater delta T is required to completely displace the attenuation fluid (11) through the cavity (6). In MODEL 3 approximately 22.5° centigrade is needed for the required displacement of fluid. A review of the models would indicate that with an initial upper reservoir (1) pressure of 0.5 or 0.6 atmospheres the present invention would function without difficulty over a very wide range of initial ambient temperatures.

By adding the fluid trap or baffle (7) and two or more window volumes of each fluid (11) and (12) the need for the louver (8) can be eliminated. The present invention could now be operated or calibrated by the pump (9), as shown in FIG. 2, so that, no matter what degree of illumination or direct sunlight entered the upper reservoir (1), the fluid interface could not be displaced into the cavity (6).

Three window volumes of different fluids may be confined in the device to create more varied effect. An example of this would be a hydrocarbon on top, water in the middle and methylene chloride on the bottom.

A single fluid version of the preferred embodiment can be accomplished in the following manner. One or both of the panes (3) and (4) is made to have an irregular or frosted interior surface on a glass substrate. The panes (3) and (4) are then coated with Fluorocarbon polymer, or suitable substitute so as to prevent surface wetting within the cavity (6). The fluid may be treated with a surfactant, ethylene glycol, dye or other additives to produce the desired effect. In this case the single fluid is the light transmissive fluid(12). The microscopic surface irregularities become filled with fluid of similar refractive index so that the frosted appearance becomes highly transmissive of light or transparent. When the upper reservoir (1) is exposed to sunlight or illumination the light transmissive fluid (12) is displaced by the gas in the upper reservoir (1). This reveals the light scattering frosted inside surface of the cavity (6) and reduces the transmission of light or illumination through the cavity (6). In this case the upper attenuation fluid (11) is the gas or air in the upper reservoir (1).

The opposite single fluid effect can be achieved by using flat fluorocarbon polymer coated glass in the cavity (6) and water with india ink as the single light attenuation fluid, in this case the light transmission fluid is the air or gas in the upper reservoir (1).

By removing the reflective shielding (13) in front of the lower reservoir and adding a second louver the device can be made to operate in the opposite direction. This is accomplished by closing the upper louver (8) and opening said lower louver to expose the lower reservoir (2) to sunlight. When sunlight strikes the lower reservoir fluid will be displaced upward through the cavity.

The shim material (5) may be bonded with both internal surfaces of panes (3) and (4) with a sufficient tensile strength to allow for window operation somewhat above an internal pressure of 1 (one) atmosphere.

A pressure sensitive switch may be mounted in the upper reservoir (1) to sound an alarm if the pressure therein exceeds or approaches 1 (one) atmosphere. Said switch also acts as a burglar alarm superior to the metallic tape presently used for such purposes.

The present invention is not limited to the preferred embodiment. The relative juxtaposition and shapes of the component parts may be changed. The reservoirs (1) and (2) cavity (6) can be rearranged by interconnecting them with tubing. The reservoirs (1) and (2) may be located, both on top of the cavity (6), both on the bottom of cavity (6) or positioned on the sides of said cavity (6). The shapes of the reservoirs (1) and (2) and cavity (6) are not constrained to rectilinear construction as shown in FIGS. 1 and 2. The panes (3) and (4) may be thought of as a light transmissive envelope enclosing the cavity (6) and may have almost any geometrical or irregular shape. The shapes of the reservoirs are not restricted to a cuboid geometry. The reservoirs may be cylindrical tanks suspended at the same height, one colored matte black, the other colored white or silver. Connective tubing with a venting valve (not shown) may be attached to said cylindrical tanks to equalize pressure between the tanks when the device is in a dark or quiescent state. Thus, the present invention may take on an infinite number of topological transformed embodiments as long as the volumes of the reservoirs (1) and (2) and cavity (6) are of the proper proportions.

The present invention can also be ganged and connected to a central computerized control which is used to actuate pump (9). The entire south facing side of a building or semicircular south facing array of windows becomes an edifice shutter to aid in heating and cooling according to the weather or climate.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A device for automatic regulation of illumination comprising (a) Two essentially vertical parallel transparent panes having an upper edge, a lower edge, and two vertical edges separated by a distance less than their thickness and sealed at said vertical edges to form a closed cavity between said panes, (b) A gas tight lower reservoir containing gas and connected at its bottom to a lower edge of said cavity in a manner suitable for fluid flow between said cavity and said lower reservoir, (c) A gas tight upper reservoir containing gas and connected at its bottom to an upper edge of said cavity, (d) An attenuation fluid confined within said cavity and said upper and lower reservoirs suitable to reduce intensity of illumination passing through said attenuation fluid, (e) A transparent light-transmissive fluid with density different from said attenuation fluid and confined with it, said transmissive fluid being immiscible with said attenuation fluid, (f) Means to isolate one of the two reservoirs from the heating effects of sun light, and (g) Means to expose the opposite reservoir to the heating effects of sun light.

2. Device in claim 1 wherein said lower reservoir is located at nearly the same height as said upper reservoir and is connected at bottom to said lower edge of said cavity by suitable means of fluid transfer such as tubes or channels and wherein means are provided for equalization of gas pressure between the upper portions of said upper and lower reservoirs during non-sunlight periods.

3. Device as in claim 1 wherein pressure inside said upper reservoir is less than atmospheric.

4. Device as in claim 3 wherein solid spacers are distributed area within said cavity to maintain constant separation in spite of subatmospheric pressure within said cavity.

5. The device in claim 1 wherein said attenuation fluid is air in the upper reservoir and a frosted surface is applied to a plurality of interior surfaces of said panes.

6. Device as in claim 1 wherein sunlight exposure at said upper reservoir is reduced by interposing an adjustable louver of opaque solid material.

* * * * *